US010378182B2

(12) United States Patent
Elbel et al.

(10) Patent No.: US 10,378,182 B2
(45) Date of Patent: Aug. 13, 2019

(54) EXCAVATOR BOOM AND EXCAVATOR

(71) Applicant: Liebherr-France SAS, Colmar (FR)

(72) Inventors: Guillaume Elbel, Colmar (FR); Thomas Münch, Reiningue (FR); Pascal Fritsch, Artzenheim (FR)

(73) Assignee: Liebherr-France SAS, Colmar (FR)

( * ) Notice: Subject to any disclaimer, the term of this patent is extended or adjusted under 35 U.S.C. 154(b) by 0 days.

(21) Appl. No.: 16/130,895

(22) Filed: Sep. 13, 2018

(65) Prior Publication Data

US 2019/0085533 A1 Mar. 21, 2019

(30) Foreign Application Priority Data

Sep. 15, 2017 (DE) ..... 10 2017 121 516

(51) Int. Cl.

| | |
|---|---|
| ***E02F 3/38*** | (2006.01) |
| ***E02F 9/14*** | (2006.01) |
| ***E02F 9/12*** | (2006.01) |
| *E02F 9/08* | (2006.01) |

(52) U.S. Cl.

CPC ..... *E02F 9/125* (2013.01); *E02F 3/38* (2013.01); *E02F 3/382* (2013.01); *E02F 9/14* (2013.01); *E02F 9/0825* (2013.01)

(58) Field of Classification Search

CPC ..... E02F 3/38; E02F 9/14
USPC ..... 414/727
See application file for complete search history.

(56) References Cited

U.S. PATENT DOCUMENTS 8,297,906 B2 * 10/2012 Nabata ..... E02F 3/38 414/685

FOREIGN PATENT DOCUMENTS

| | | | |
|---|---|---|---|
| EP | 2700752 A1 | | 2/2014 |
| JP | S4933601 U | * | 3/1974 |
| JP | S4933601 U | | 3/1974 |
| JP | 2016157140 A | | 9/2016 |

* cited by examiner

*Primary Examiner* — Gerald McClain
(74) *Attorney, Agent, or Firm* — McCoy Russell LLP

(57) ABSTRACT

The present invention relates to a boom for an earth-moving machine, in particular an excavator, with at least two bearing plates for supporting a cylinder unit, which at least for the most part extend parallel to each other in the longitudinal direction of the boom, wherein the bearing plates have an end-side curvature extending outwardly to the lateral edge of the boom.

20 Claims, 2 Drawing Sheets

EXCAVATOR BOOM AND EXCAVATOR

This invention relates to a boom for an earth-moving machine, in particular an excavator, with at least two bearing plates for supporting a cylinder unit, which at least for the most part extend parallel to each other in the longitudinal direction of the boom.

TECHNICAL FIELD

Different boom structures are sufficiently known from the prior art. The formation of possible bearing points for the connection of linear actuators likewise is known, wherein the same are formed in the form of two parallel bearing plates depending on the structure. As the boom is exposed to relatively great loads in the region of the actuator connection, the bearing plates regularly are provided with additional reinforcing plates and/or manufactured with very large plate thicknesses. This measure however is expensive and leads to a disadvantageous increase of the total boom weight.

BACKGROUND AND SUMMARY

The object of the present invention consists in searching for possible solutions to the problem when designing the bearing points for generic boom structures.

This object is solved by a boom for an earth-moving machine, in particular an excavator, comprising one or more bearing plates for supporting a cylinder unit, wherein at least one bearing plate includes an end-side curvature extending outwardly to a lateral edge of the boom, a boom upper side is broadened in a region of the outwardly running bearing plate or plates, and the bearing plate or plates extend up to the broadened boom upper side. Advantageous aspects of the boom are subject-matter of the dependent claims. In connection with the invention, the term boom is used comprehensively. For example, it also comprises a so-called dipper arm.

According to the invention, it is proposed for the generic boom to configure the bearing plate or plates with a curvature which at the end extends outwardly to the lateral edge of the boom. The invention applies both to boom configurations with only one bearing plate and to configurations with two or more bearing plates. For the sake of simplicity, the invention and its advantageous embodiments will always be described below with reference to a configuration with two bearing plates, but the following explanations equally apply to a boom configuration with only one or more than two bearing plates.

In a configuration with a plurality of bearing plates the same accordingly no longer extend parallel in the end portion, but the distance between the bearing plates increases. The special curvature in the end region of the bearing plates, in particular in the end region of the bearing plates facing the boom tip, has an advantageous effect on the resulting mechanical stiffness of the boom, in particular in the region of the arranged bearing plates, as the dissipation of force from the bearing point into the boom can be distributed better. Ideally, possible reinforcing plates, as they are commonly used in the prior art, thereby can be omitted. Moreover, the plate thickness of the bearing plates can be reduced. In total, the construction according to the invention permits a distinct weight reduction. The lower expenditure of material and time in the manufacture of the boom according to the invention provides for a positive saving of costs.

According to the invention, at least one bearing plate or both bearing plates at their ends is/are guided up to the edge of the boom upper side and adjoins/adjoin the formed edge of the boom surface with the side faces. Furthermore, it is provided here that the boom upper side is broadened in the region of the outwardly running bearing plates, i.e. the entire boom profile is designed broader in the region of the at least one bearing plate or the adjacent bearing plates so that the latter are extended beyond the original edge between surface and side part and are positioned on the expanded boom region, i.e. the lateral broadening of the boom. Due to this construction, the ends of the bearing plates are loaded less.

According to a preferred embodiment, the bearing plate or plates can be perpendicularly attached to the boom upper side.

The boom can cohesively be assembled from a rear and a front boom part to obtain a boomerang-like boom structure, but the invention in principle can be used for any boom structure.

It is conceivable that the bearing plates extend outwardly each with an identical radius of curvature. It is likewise conceivable, however, to provide individual bearing plates with different radii of curvature.

The proposed bearing plate or plates serve for supporting a cylinder that serves for actuating an attachment mounted on the boom and/or a boom extension. The corresponding attachment additionally can include a corresponding boom extension, wherein a corresponding cylinder unit then serves for actuating the boom extension.

Furthermore, it is preferred when the curvature of the bearing plate or plates directly adjoins a bolt receptacle of the bearing plates. Corresponding bearing plates usually are formed by a bearing plate which in the region of the broadest point provides an appropriate bore for receiving a bearing bolt. In the direction of the boom foot the width of the bearing plates usually can be reduced steadily. In the direction of the boom tip an abrupt reduction of the plate width preferably is effected, wherein the bearing plate reduced in width then is guided outwardly to the edge of the boom surface with a corresponding radius of curvature.

The boom construction is assembled from at least one front and at least one rear boom part. The bearing plate or plates for example at least for the most part can extend on the boom upper side of the front boom part. According to a preferred aspect of the invention at least one upper connecting plate can be provided in the connecting region between the boom parts, which ideally represents a part of the boom upper side in the connecting region of the boom parts. The connecting plate provides an appropriate curvature depending on the angle of the two boom parts relative to each other. In the case of such a special construction of the boom it is particularly advantageous when the bearing plates extend from the boom upper side of the front boom part to the upper connecting plate. At their ends, the bearing plates usually welded to the boom parts then reach into a boom region loaded less onto the connecting plate. The welding seams necessary there accordingly are subject to a lower stress load, which has a positive effect on their fatigue resistance. An otherwise necessary aftertreatment of the welding seams might be omitted.

Beside the inventive boom the present invention also relates to an earth-moving machine, in particular an excavator with at least one boom according to the present invention. The advantages and properties of the earth-moving machine accordingly quite obviously correspond to the advantages and properties discussed already in connection with the excavator boom according to the invention, which is why a repetitive description is omitted at this point.

Further advantages and properties of the invention will be explained in detail below with reference to an exemplary embodiment illustrated in the Figures.

DETAILED DESCRIPTION

Figure 1:
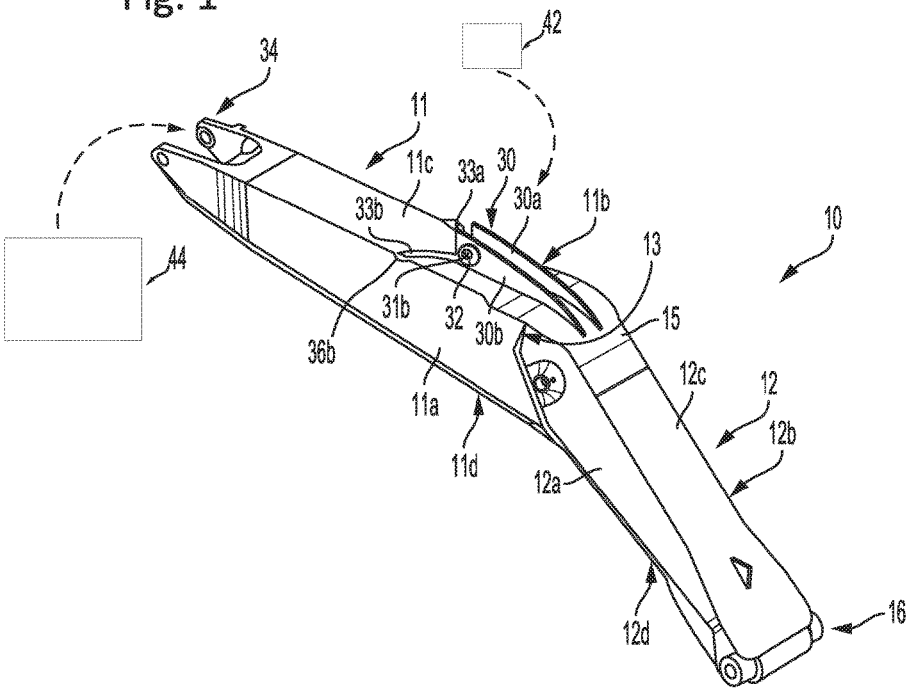
FIG. 1 shows a perspective top view of the excavator boom according to the invention.
Figure 2:
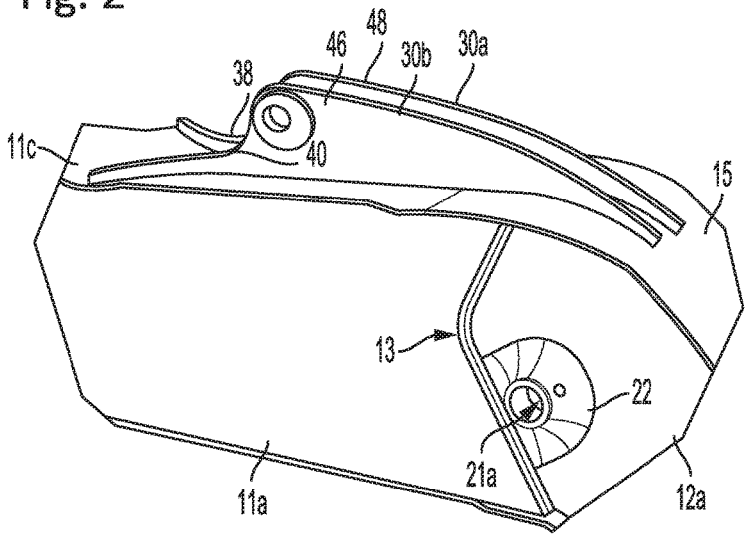
FIG. 2 shows a detail view of the connecting point between the front and rear excavator boom parts.
Figure 3:
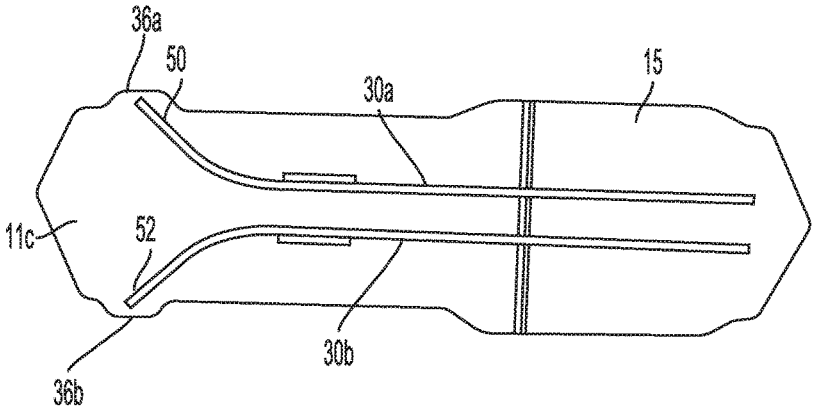
FIG. 3 shows a detail view of the connecting region of FIG. 2 with an open side face of the boom arm.

The perspective side view of FIG. 1 shows the total construction of the excavator boom 10 according to the invention. The same consists of a front boom part 11 and a rear boom part 12. At the front boom part connecting points 34 are provided for movably mounting a non-illustrated attachment or a boom extension. The rear boom part 12 comprises corresponding bearing points 16 at its end in order to be able to luffingly articulate the same to an excavator upper-carriage or undercarriage.

Both the rear and the front boom part can be fabricated as a monoblock. It is likewise possible, however, to assembly the boom parts 11, 12 from individual elements.

Both boom parts 11, 12 have a box-shaped structure that is obtained by welding together corresponding side plates. The individual side plates 11*a* to 11*d* and 12*a* to 12*d* are welded together by a fillet welding method.

The connection between the two boom parts 11, 12 is created by the central connecting plate 13, wherein at least the front edges of the side plates 11*a*, 11*b* and 12*a*, 12*b* and possibly of the undersides 11*d* and 12*d* are cohesively connected to each other via the connecting plate 13. The connecting plate 13 has a curved shape, whereby possibly a curved contact edge of the boom parts 11, 12 is obtained along the side plates 11*a*, 11*b*, 12*a*, 12*b*. The connecting plate 13 is designed as a simple, thick plate. It allows a simple connection between the boom parts 11, 12 and correspondingly a simple adaptation to the desired angle that is formed by the two boom elements 11, 12. In addition, it is also possible to flexibly react to the desired width of the box-shaped boom parts 11, 12, i.e. the width of the respective side faces 11*c*, 12*c*. The construction the leads to a distinct reduction of the incurred manufacturing costs and the resulting total weight of the boom 10.

In the region of the boom upper side the boom surfaces 11*c* and 12*c* of the boom parts 11, 12 are not directly connected with each other. Instead, a plate-shaped upper connecting plate 15 is inserted here or overlappingly placed on the upper sides 11*c*, 12*c* and welded to the two boom parts 11, 12. The plate-shaped upper connecting plate 15 is bent corresponding to the angle formed by the two boom parts 11, 12 relative to each other. Possibly, the boom underside might also be designed with a corresponding connecting element.

In the region of the rear boom part 12 a cylindrical tube 21 extends through the boom box 12 transversely to the longitudinal boom axis, which is welded to the central connecting plate 13. Mounting the bearing tube 21 on the central connecting plate 13 at the same time ensures that the total stiffness of the boom can additionally be increased. Via outlet openings 21*a*, 21*b* within the side elements 12*a*, 12*b* an appropriate bolt can be put into the cylinder tube 21. In the region of the outlet openings 21*a*, 21*b* additional reinforcing plates 22 are also mounted on the outside of the side plates 12*a*,12*b*. The tube 21 forms the bearing point for the connection of a luffing cylinder of the excavator according to the invention, which extends from the bearing point 21 of the rear boom part 12 to the uppercarriage of the excavator.

For supporting a further hydraulic adjusting means in the form of a hydraulic cylinder an additional bearing point 30 is provided on the upper side of the boom 10, which provides for accommodating a cylinder that extends from the bearing point 30 up to an attachment received at the bearing point.

The bearing point 30 consists of two bearing plates 30*a*, 30*b* extending in parallel, which are perpendicular to the boom upper side and extend parallel in the longitudinal direction of the boom. In the region with the largest width, a bore 31*a*, 31*b* each is provided for receiving a bolt, wherein the bore edge is reinforced with additional plates 32. The width of the bearing plates 30*a*, 30*b* steadily decreases at 46, 48 in the direction of the rear boom part 12. The bearing plates serve for supporting a cylinder unit 42 that serves for actuating an attachment mounted on the boom and/or a boom extension. The corresponding attachment additionally can include a corresponding boom extension, wherein a corresponding cylinder unit then serves for actuating the boom extension of the earth moving machine such as an excavator 44. The majority of the bearing plates including the bores 31*a*, 31*b* are arranged on the upper side 11*a* of the front boom part 11, but both plates 30*a*, 30*b* extend in parallel except for the upper connecting plate 15 to which the plate ends are welded. The extension of the bearing plates 30*a*, 30*b* up to the connecting plate 15 has the advantage that the end of the formed welding seam lies in a region of the boom to which less force is applied, whereby not only the material fatigue resistance can be increased, but manufacturing costs also can be lowered, as in this case no additional aftertreatment of the welding seam is necessary.

Furthermore, it can be seen that the width of the bearing plates 30*a*, 30*b* after the bore 31*a*, 31*b* abruptly decreases in the direction of the boom tip and then remains almost constant. These bearing plate portions 33*a*, 33*b* of reduced, but almost constant width have a curvature 38, 40 so that the plate portions 33*a*, 33*b* do not extend parallel to each other, but outwardly to the edges of the surface 11*c* of the front boom part 11. The special curvature in the end region 50, 52 of the bearing plates facing the boom tip, has an advantageous effect on the resulting mechanical stiffness of the boom, in particular in the region of the arranged bearing plates, as the dissipation of force from the bearing point into the boom can be distributed better.

The upper plate 11*a* of the front boom part 11 can be broadened in the region 36*a* and 36*b* of the bearing plate portions 33*a*, 33*b* adjoining the edge so that the plate elements 33*a*, 33*b* can protrude beyond the actual edge of the front boom part. Due to the bend of the bearing plates 30*a*, 30*b* the total stiffness of the bearing can be increased, but without having to increase the thickness of the bearing plates 30*a*, 30*b*. In addition, it is not necessary either to mount further reinforcing plates in the region of the bearing point. Thereby, the total weight of the boom can further be reduced and its manufacture can further be simplified.

The invention claimed is:

1. A boom for an earth-moving machine comprising one or more bearing plates for supporting a cylinder unit, wherein at least one bearing plate of the one or more bearing plates includes an end-side curvature extending outwardly to a lateral edge of the boom, wherein a boom upper side is broadened in a region of the outwardly running bearing plate or plates, wherein the one or more bearing plates extend up to the broadened boom upper side, and wherein a plurality of bearing plates extends outwardly and each bearing plate end side that extends outwardly is disposed on the boom upper side in the broadened region.

2. The boom according to claim 1, wherein at least two bearing plates of the one or more bearing plates extend parallel to each other in a longitudinal direction of the boom.

3. The boom according to claim 1, wherein at least one bearing plate of the one or more bearing plates is perpendicularly attached to the boom upper side, wherein the boom is cohesively assembled from a rear boom part and a front boom part to obtain a boomerang shaped boom structure.

4. The boom according to claim 3, wherein the at least one of the one or more bearing plates extend on a boom upper side of the front boom part.

5. The boom according to claim 4, wherein the front and rear boom parts at least partly are directly connected to each other and in addition a connection between the front and rear boom parts is provided by means of at least one upper connecting plate, wherein the one or more bearing plates extend from a boom upper side of the front boom part to the connecting plate.

6. The boom according to claim 3, wherein the front and rear boom parts at least partly are directly connected to each other and in addition a connection between the front and rear boom parts is provided by means of at least one upper connecting plate, wherein the one or more bearing plates extend from a boom upper side of the front boom part to the connecting plate.

7. The boom according to claim 6, wherein a width of the at least one bearing plate of the one or more bearing plates is reduced from a bolt receptacle in a direction of the rear boom part.

8. The boom according to claim 6, wherein the at least one of the one or more bearing plates end on the upper connecting plate.

9. The boom according to claim 7, wherein the width of the at least one of the one or more bearing plates continuously decreases from the bolt receptacle in the direction of the rear boom part.

10. The boom according to claim 3, wherein each of the plurality of bearing plates extends outwardly with an identical radius of curvature.

11. The boom according to claim 3, wherein the one or more bearing plates are provided for supporting a cylinder for actuation of an attachment and/or a boom extension.

12. The boom according to claim 1, wherein each of the plurality of bearing plates extends outwardly with an identical radius of curvature.

13. The boom according to claim 1, wherein the earth-moving machine is an excavator.

14. The boom according to claim 1, wherein the at least one bearing plate of the one or more bearing plates is provided for supporting a cylinder for actuation of an attachment and/or a boom extension.

15. The boom according to claim 1, wherein an end region of the at least one bearing plate of the one or more bearing plates extending to a boom tip has the end-side curvature.

16. The boom according to claim 15, wherein a width of the at least one bearing plate of the one or more bearing plates decreases after a bolt receptacle in a direction of the boom tip.

17. The boom according to claim 1, wherein a plate region of the at least one bearing plate of the one or more bearing plates directly adjoining a bolt receptacle extends outwardly.

18. The boom according to claim 17, wherein a width of the at least one bearing plate of the one or more bearing plates decreases after the bolt receptacle in a direction of a boom tip.

19. An earth-moving machine with at least one boom comprising one or more bearing plates for supporting a cylinder unit, wherein at least one bearing plate of the one or more bearing plates includes an end-side curvature extending outwardly to a lateral edge of the boom, wherein a boom upper side is broadened in a region of the outwardly running bearing plate or plates, wherein the bearing plate or plates extend up to the broadened boom upper, and wherein a plurality of bearing plates extends outwardly and each bearing plate end side that extends outwardly is disposed on the boom upper side in the broadened region.

20. The earth-moving machine according to claim 19, wherein the earth-moving machine is an excavator.

* * * * *